US006257119B1

(12) United States Patent
Ryken et al.

(10) Patent No.: US 6,257,119 B1
(45) Date of Patent: Jul. 10, 2001

(54) BALL JOINT FOR SERVO PISTON ACTUATION IN A BENT AXIS HYDRAULIC UNIT

(75) Inventors: James D. Ryken, Roland; David D. Dirks, Ames; Doug Kardell, Grimes, all of IA (US); Wilhelm Göllner, Neumünster (DE)

(73) Assignee: Sauer-Danfoss Inc., Ames, IA (US)

( * ) Notice: Subject to any disclaimer, the term of this patent is extended or adjusted under 35 U.S.C. 154(b) by 0 days.

(21) Appl. No.: 09/390,128

(22) Filed: Sep. 3, 1999

Related U.S. Application Data

(60) Provisional application No. 60/121,861, filed on Feb. 26, 1999, provisional application No. 60/121,948, filed on Feb. 26, 1999, and provisional application No. 60/121,947, filed on Feb. 26, 1999.

(51) Int. Cl.[7] ..... F01B 3/02
(52) U.S. Cl. ..... 91/506
(58) Field of Search ..... 91/382, 499, 506; 92/12.2, 57, 71

(56) References Cited

U.S. PATENT DOCUMENTS

| | | | | |
|---|---|---|---|---|
| 2,931,250 | | 4/1960 | Ebert . | |
| 3,142,963 | | 8/1964 | Thoma . | |
| 3,148,628 | | 9/1964 | Boydell . | |
| 3,958,496 | | 5/1976 | Wallin . | |
| 4,273,517 | * | 6/1981 | Heyl | 92/506 |
| 4,843,950 | * | 7/1989 | Heyl | 92/12.2 |
| 4,893,549 | | 1/1990 | Forster . | |

OTHER PUBLICATIONS

"Data Sheet for Variable Pump/Motor V20," Volvo Hydraulics, pp. 1–4, published prior to 1980.

"Hydrostatics for power split transmission," E. Skirde & M. Gigling, Industrial Vehicle Technology '98, pp. 30–33, published 1998.

* cited by examiner

*Primary Examiner*—F. Daniel Lopez
(74) *Attorney, Agent, or Firm*—Zarley, McKee, Thomte, Voorhees & Sease

(57) ABSTRACT

A special ball joint for servo piston actuation in a bent axis unit includes an elongated actuator rod having a substantially spherical external surface on a first end and a servo piston on a second end. Also included is a single-piece yoke adapted to carry a cylinder block and rotate about an axis of rotation. A socket having a substantially spherical surface is interposed between the yoke and the spherical surface on the rod such that the actuator rod rotates the yoke with forces residing in at least two planes when hydraulic pressure is applied to the servo piston. Two servo pistons and two such ball joints can be applied to the yoke to obtain rotation of the yoke which is up to greater than plus or minus 45° from a neutral position. The external surface on the first end of the actuator rod and the socket must be mating so as to provide freedom of movement. The socket can be incorporated into the yoke itself. The foregoing servo pistons are received in servo bores of a one-piece control housing. An integral cam is formed in a control trunnion to accommodate the swinging movement of the yoke.

13 Claims, 6 Drawing Sheets

BALL JOINT FOR SERVO PISTON ACTUATION IN A BENT AXIS HYDRAULIC UNIT

CROSS-REFERENCE TO RELATED APPLICATIONS

This application claims the benefit of U.S. provisional application(s) Ser. No.(s) 60/121,861; 60/121,948; and 60/121,947; which were all filed Feb. 26, 1999.

BACKGROUND OF THE INVENTION

The present invention relates to hydraulic units of the bent axis type. More particularly, this invention relates to a swinging yoke type bent axis hydraulic unit.

Bent axis hydraulic units have been known for many years. The most widespread or common of the bent axis designs utilizes a "tilting block" such as disclosed by Forster in U.S. Pat. No. 4,893,549. A rotatable cylindrical drum or cylinder block kit has a plurality of axial pistons therein supported on a nonrotatable swivel carriage on its axis of rotation. The swivel carriage has a convex end face positioned against a concave swivel carriage guide surface. The swivel carriage guide surface is part of the swivel carriage housing, which is attached to the machine housing by a flange connection. The cylinder block kit and carriage tilt or pivot to vary displacement.

Other bent axis units utilize a "swinging yoke" configuration. The cylinder block kit is carried by the yoke and swings with it to vary the displacement of the unit. There is a need for a swinging yoke bent axis hydraulic unit which incorporates some of the best features of both the tilting block and swinging yoke configurations.

A primary objective of the present invention is the provision of a swinging yoke bent axis hydraulic unit having up to greater than plus or minus 45° of yoke swing as a result of a ball joint between the actuator and the yoke.

Another objective of this invention is the provision of an actuator rod and socket for connecting a servo piston and a swinging yoke such that the rod can move in more than one plane.

Another objective of this invention is the provision of a substantially spherical socket for connecting the actuator rod and the yoke with multiple degrees of freedom.

Another objective of this invention is the provision of bent axis angles up to greater than 90° to maximize the power density of the hydraulic unit.

Another objective is the provision of a socket joint with multiple degrees of freedom in combination with a servo piston which is tiltable within its bore.

Another objective of this invention is a swinging yoke bent axis configuration which is easy to assemble, economical to produce, keeps the number of required parts to a minimum, and is durable and reliable in use.

These and other objectives will be apparent from the drawings, as well as from the description and claims which follow.

SUMMARY OF THE INVENTION

The present invention relates to a special ball joint for servo piston actuation of a bent axis unit. The ball joint includes an elongated actuator rod having a substantially spherical external surface on a first end and a servo piston on a second end. Also included is a yoke adapted to carry a cylinder block and rotate about an axis of rotation. A socket having a substantially spherical surface is interposed between the yoke and the spherical surface on the rod such that the actuator rod rotates the yoke when hydraulic pressure is applied to the servo piston. Two servo pistons and two such ball joints can be applied to rotate the yoke to angles up to greater than plus or minus 45° from a neutral position. The external surface on the first end of the actuator rod and the socket must be mating so as to provide freedom of movement. The socket can be incorporated into the yoke itself.

DETAILED DESCRIPTION OF THE PREFERRED EMBODIMENT

Figure 1:
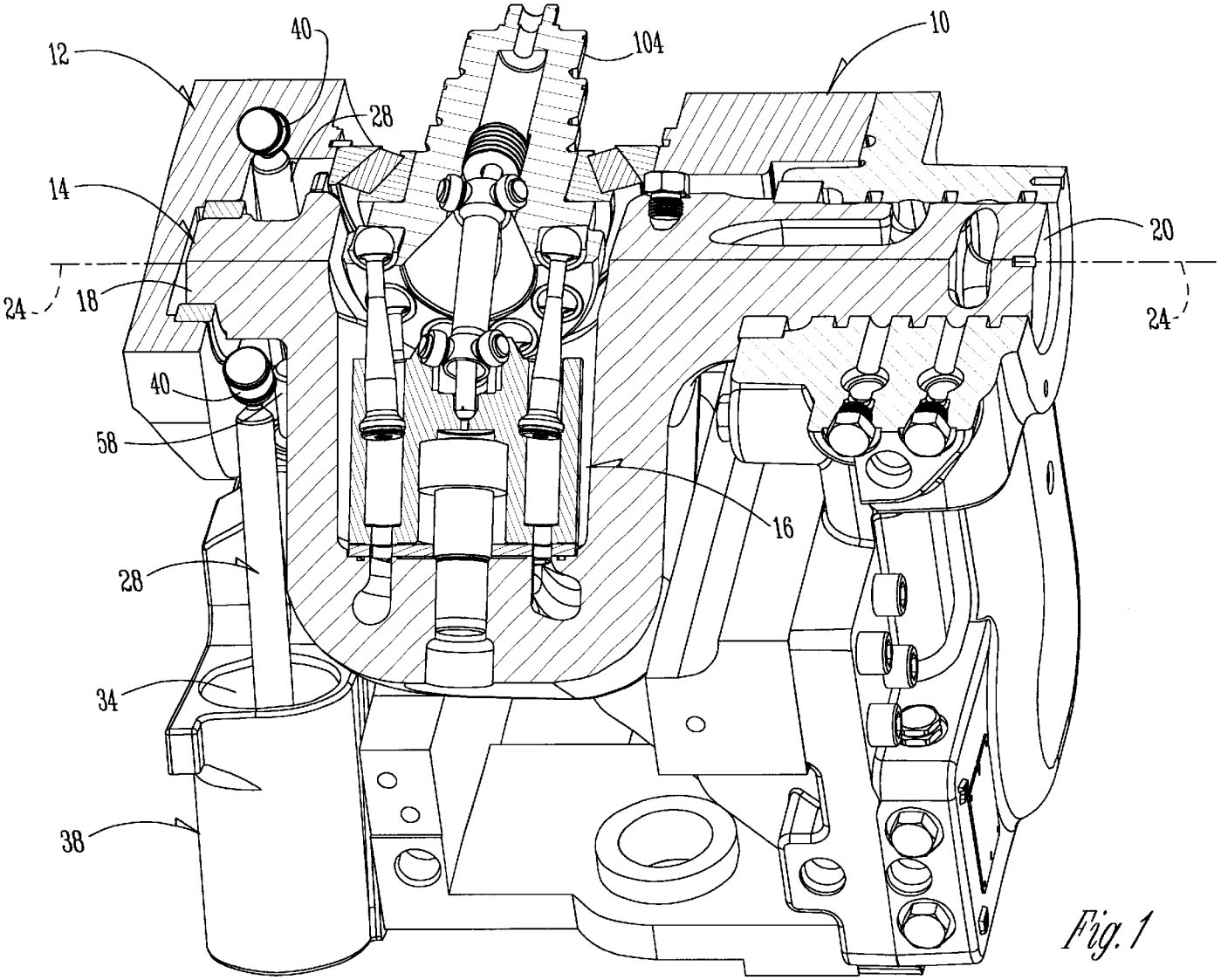
FIG. 1 is a perspective view of the bent axis hydraulic unit of this invention. Portions of the housing have been removed for clarity and to better expose some of the internal components.
Figure 2:
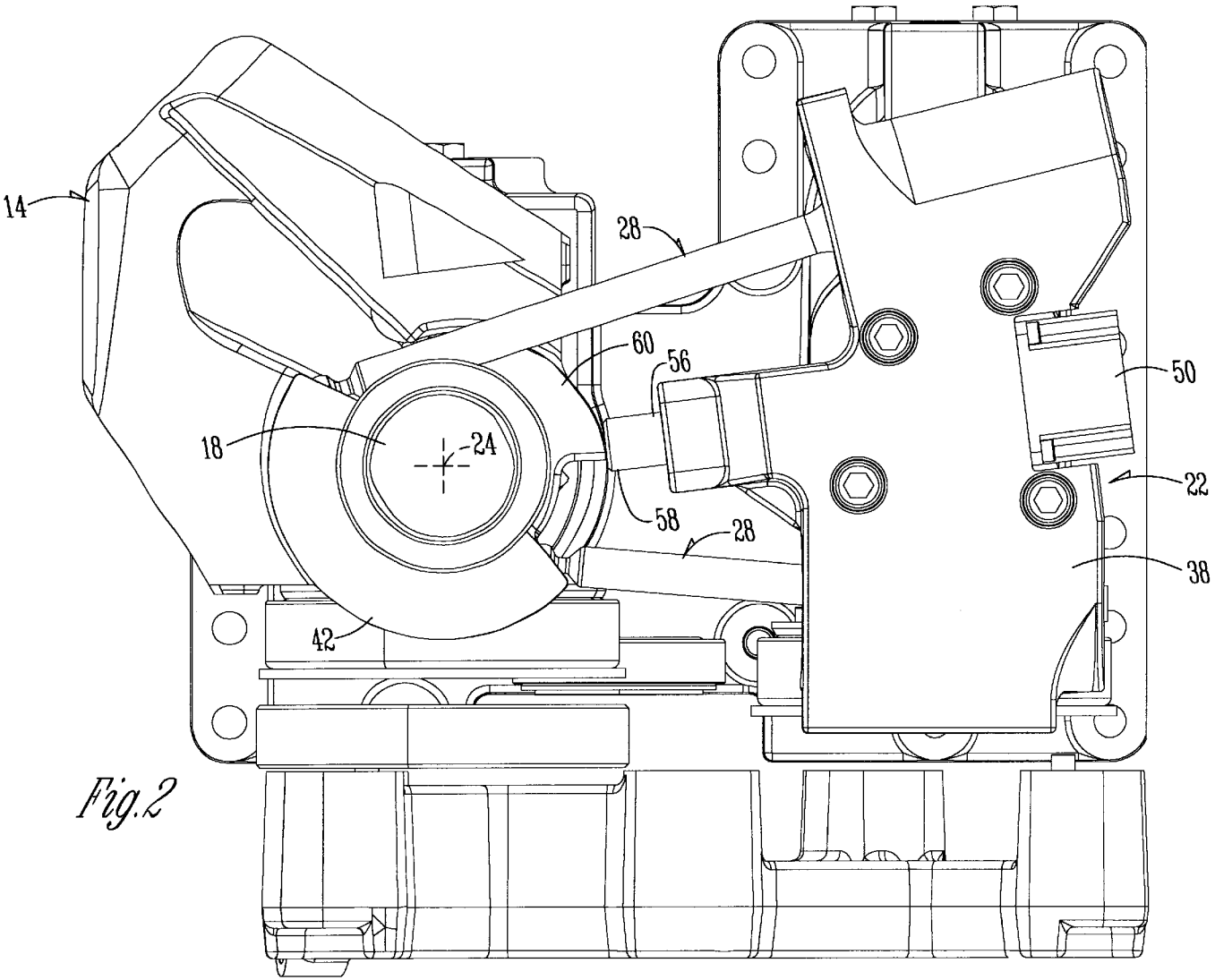
FIG. 2 is a view of the left side of the bent axis unit of FIG. 1 when viewed from the rear of the unit. This view shows the control for swinging the yoke.

FIG. 1 depicts a bent axis variable displacement hydraulic unit 10. The bent axis unit 10 includes a supporting frame or housing 12, much of which is irrelevant to this invention and therefore has been cut away to allow the internal components to be seen more clearly. The displacement of the bent axis unit 10 is varied by a single-piece swinging yoke 14 which carries a conventional cylinder block or cylinder block kit 16 drivingly connected to a main shaft 104 that is rotatably supported in the housing 12. The yoke 14 is forced to swing or pivot about a pair of opposing pivot arms or trunnions 18, 20 by control 22. Preferably the trunnions 18, 20 share a common, fixed pivot axis or axis of rotation 24.

Figure 5:
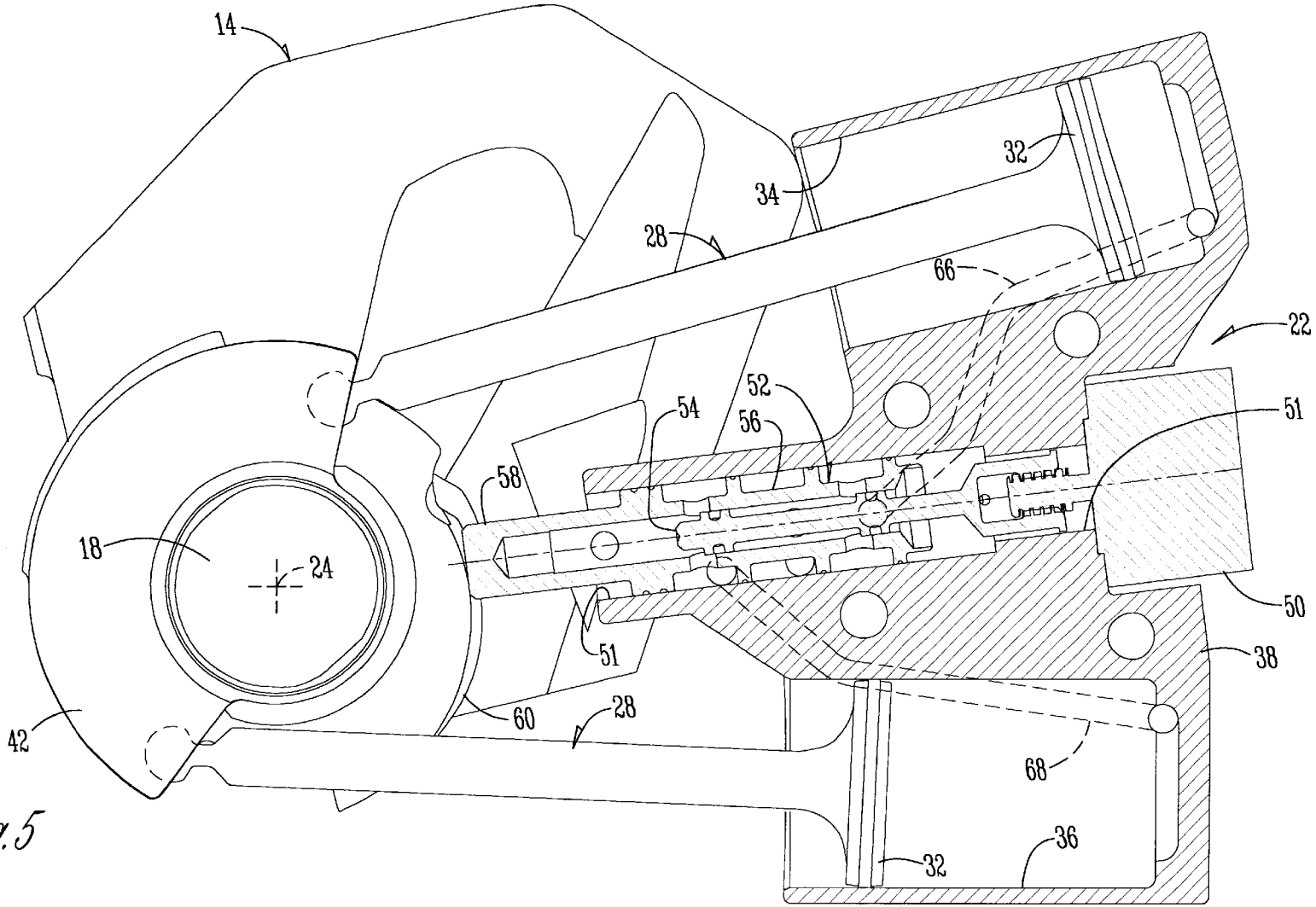
FIG. 5 is a view similar to FIG. 4, but shows the yoke disposed near the other end of its range of swingable movement.
Figure 6:
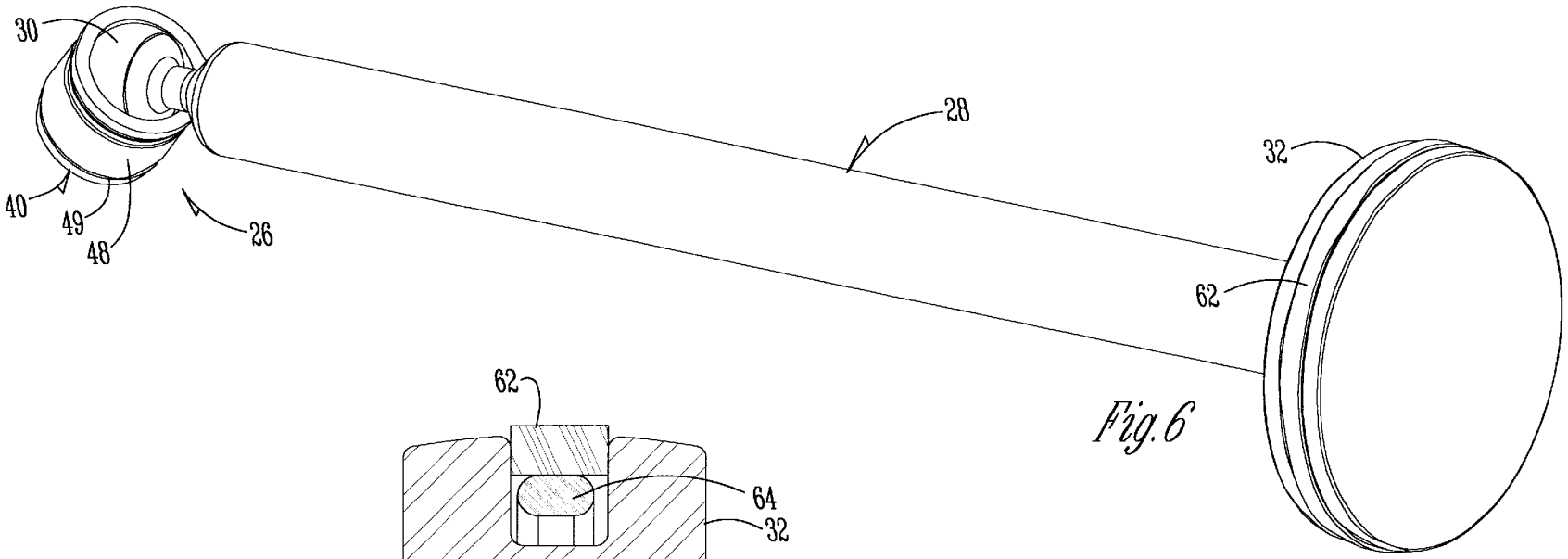
FIG. 6 is a perspective view of the actuator rod assembly and ball-and-socket joint of this invention.
Figure 7:
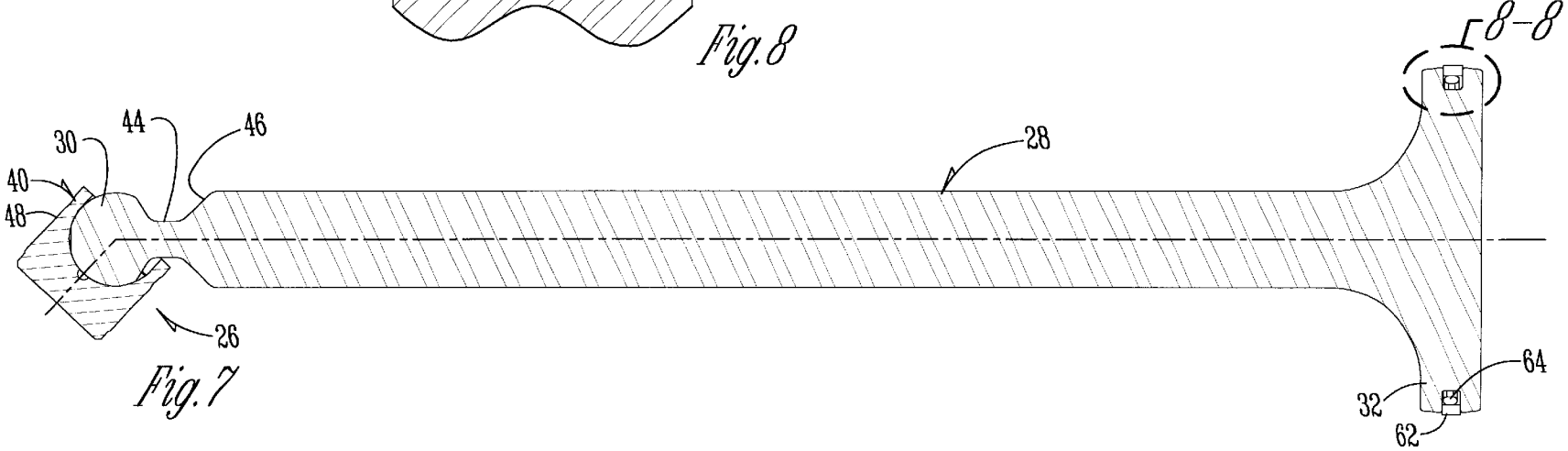
FIG. 7 is a cross-sectional view of the assembly of FIG. 6 and illustrates that the socket can pivot up to greater than 90° in a given plane.

As best understood in view of FIGS. 1, 6, and 7, a universal ball-and-socket joint 26 is operatively associated with the yoke 14 at the trunnion 18. An elongated actuator rod 28 has a substantially spherical and preferably external surface 30 on a first end and a servo piston 32 on the second end. As seen in FIGS. 2–5, a similar actuator rod 28 is provided on the other side of the axis of rotation 24. The servo pistons 32 are slidably, sealingly, and tiltably received respectively in servo bores 34 and 36 of a one-piece control housing 38. Although many arrangements are possible, each of the servo bores 34, 36 preferably has a central axes which is skewed with respect to the other servo bore. The bores 34, 36 need not be parallel to each other. As a result, the central axes of the servo bores 34, 36 can form a variety of angles with respect to the trunnion 18. Displacement control could be applied at trunnion 20, as well as or instead of trunnion 18. Thus, force can be applied by the actuator rod 28 to swing or rotate the yoke up to greater than 90°. In other words, a range of up to greater than plus or minus forty-five degrees from the neutral or midpoint position is provided. The control forces on the yoke 14 can reside in more than one plane.

Figure 3:
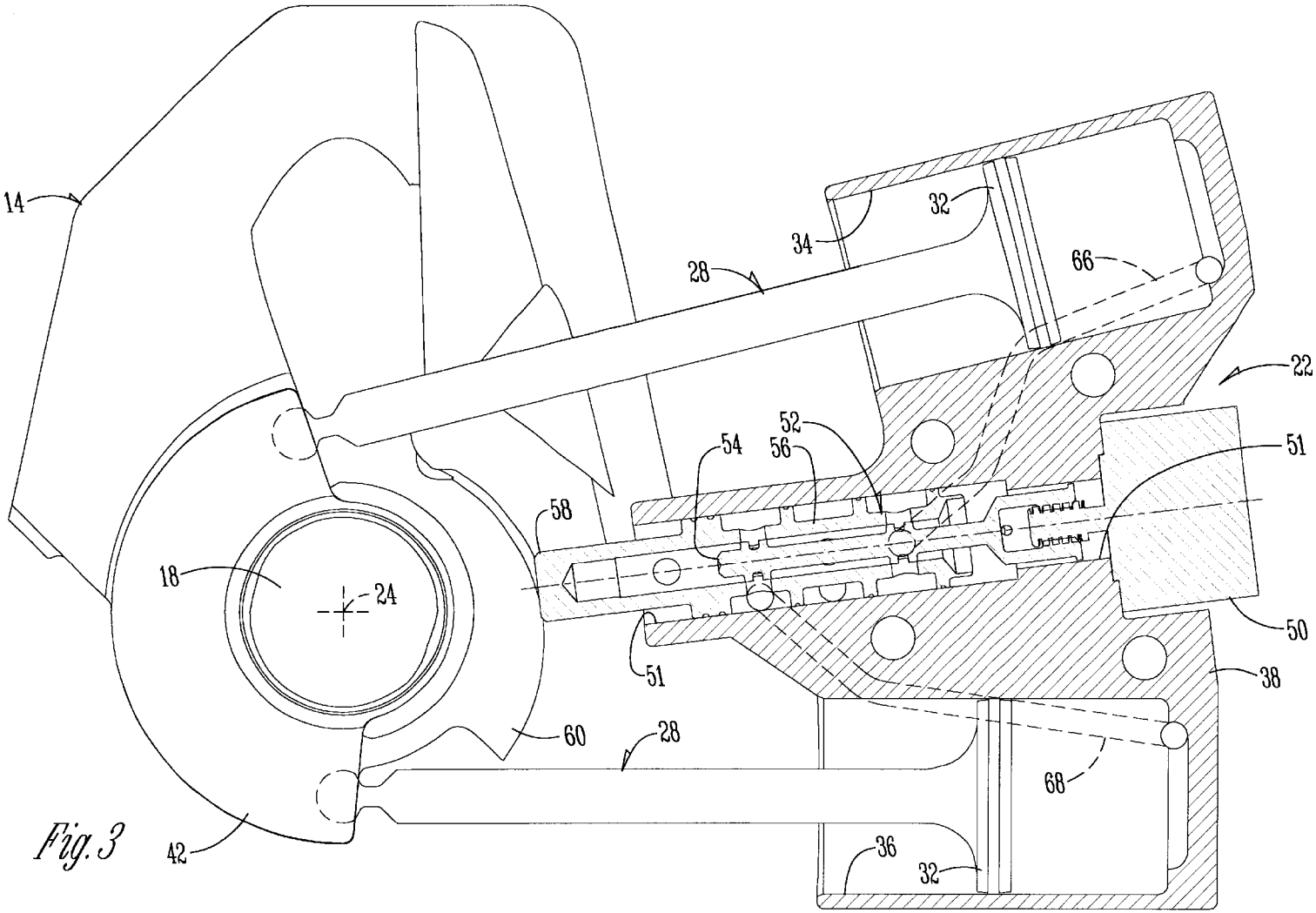
FIG. 3 is view similar to FIG. 2, but shows the control housing sectioned to expose the servo bores, the control bore, and the fluid passages between the servo bores and the control bore. The yoke is disposed at the approximate midpoint of its range of swinging movement.
Figure 4:
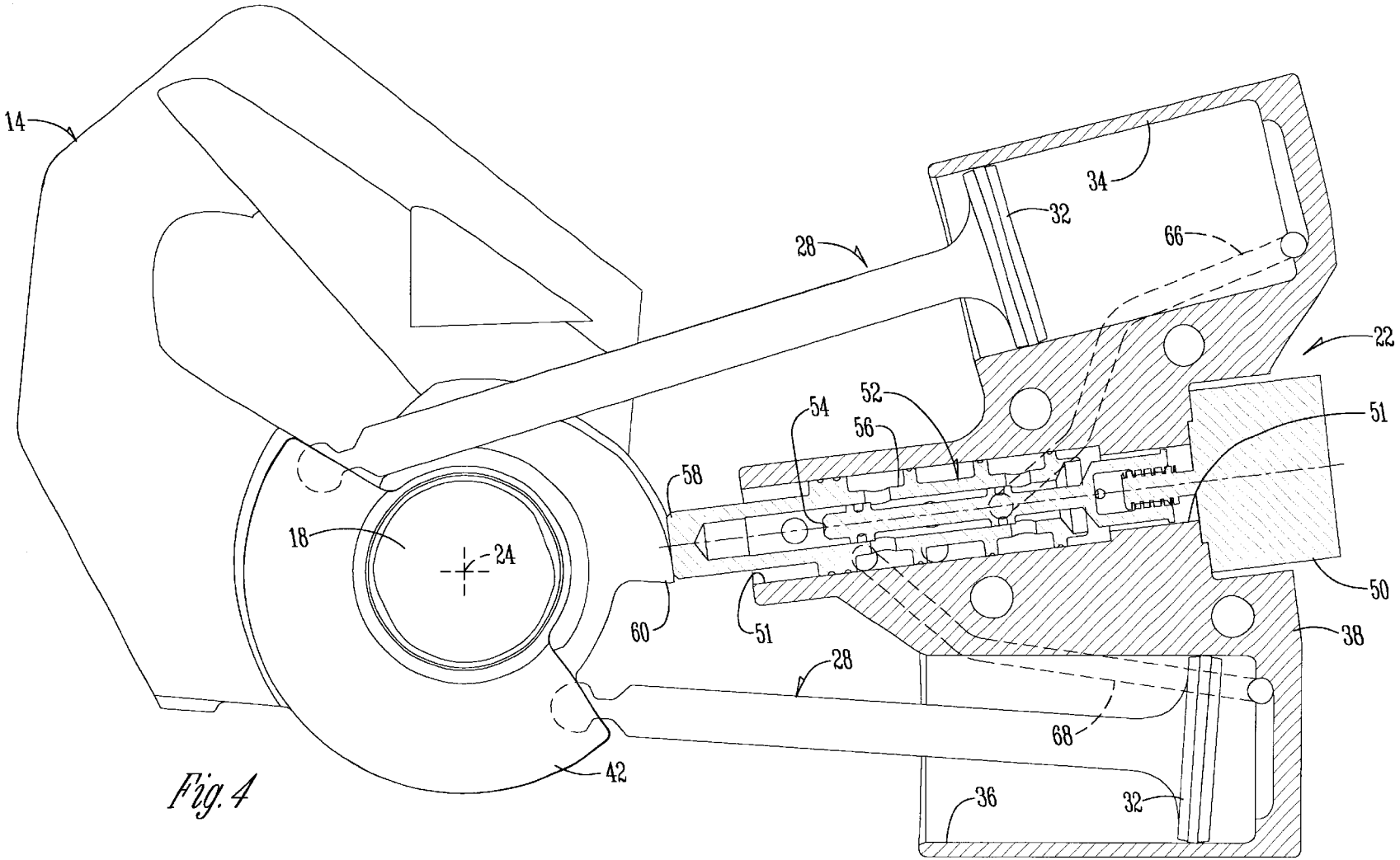
FIG. 4 is view similar to FIG. 3, but shows the yoke disposed near one end of its range of swingable movement.

Referring to FIGS. 3–5 (where the control housing 38 has been removed) and FIGS. 6–7, the various components required for servo piston actuation of the swinging yoke 14 are illustrated. A socket member 40 is interposed between the spherical surface 30 of the actuator rod 28 and the control trunnion body flange 42 on the yoke 14. It is contemplated that the socket member 40 could just comprise a bore in the body flange 42, and not require a separate part.

The actuator 28 has a ball end or spherical surface 30 generally opposite a servo piston 32. The rod 28 has a sturdy cross-section and is formed of a rigid material having sufficient strength to handle the expected loads and stresses. The actuator rod 28 has a reduced diameter portion 44 rearwardly adjacent the ball end 30. A tapered portion 46 connects the reduced diameter portion 44 with the intermediate portion of the actuator rod 28.

The mating portion of the ball-and-socket joint includes a socket 48 which is preferably constructed of a malleable material, such as brass. The socket 48 is crimped or otherwise attached to the ball end 30 of the actuator rod 28 so that the socket 48 freely pivots around the ball end 30. The reduced diameter and tapered portions 44, 46 help provide clearance for relative movement of the ball and socket. The socket 48 has a substantially cylindrical outer surface, an open end, and a closed end.

Returning to FIGS. 1–5, the control 22 also includes a stepper motor 50 located in a control bore 51 between the servo bores 34 and 36 in the control housing 38. The stepper motor 50 operatively engages a linearly actuated hydraulic displacement control 52 which has the necessary conventional and appropriate porting to port oil to the servo bores 34, 36 respectively based on electrical commands from the operator to the stepper motor. The displacement control 52 has a spool 54 slidably mounted in a surrounding sleeve 56. The end of the sleeve 56 which is remote from the stepper motor 50 serves as a feedback mechanism 58 by engaging an integral cam member 60 formed on the yoke 14.

The cam member 60 is preferably a radial and eccentric protrusion on the control trunnion 18. The integral cam member 60 extends in a plane which is generally perpendicular to the axis of rotation of the trunnions 24. Thus, when the yoke 14 is swung or pivotally rotated about the trunnion axis 24, the feedback member or remote end 58 of the sleeve 54 follows along the cam member 60 and thereby is forced toward or allowed to move away from the control housing 38, whichever the case may be. The resulting relative movement between the sleeve 54 and the spool 56 provides feedback to the control 52 and ports oil to or from the servo bores 34, 36 accordingly. The control can modulate in a closed-loop manner to maintain a given yoke position or fluid displacement. The integral cam member 60 extends around the control trunnion 18 far enough to accommodate the full swinging movement of the yoke 14. Since the yoke 14 preferably swings up to greater than 90°, the cam member 60 extends at least 90° around the trunnion 18.

FIGS. 1–5 depict additional features of the control 22 of this invention. The control 22 includes a one-piece control housing 38, which has a pair of servo bores 34, 36 formed therein. The servo bores 34, 36 are generally directed toward the trunnion 18, but they are not necessarily perpendicular to the housing 38 which preferably has a somewhat irregular shape. However, the overall shape of the control 22 is substantially rectangular. The housing 38 of the control 22 has two outer portions which house the servo bores 34, 36 respectively therein. Servo pistons 32 on the ends of the actuator rods 28 slidably extend into the bores 34, 36.

Figure 8:
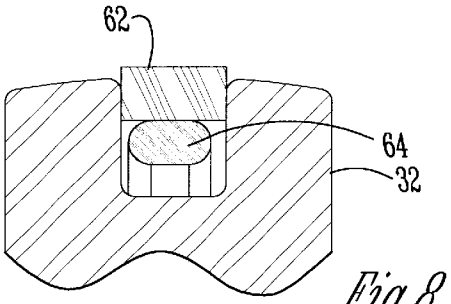
FIG. 8 is an enlarged cross-sectional view taken of the area 8—8 in FIG. 7.

Due to the locations of the connections of the actuator rods 28 with the body flange 42 of the yoke 14, the servo pistons 32 sometimes tilt substantially within the servo bores 34, 36. Normally this would present a wear and leakage problem, but the O-ring and sealing ring configuration shown in FIG. 8 reduces the sliding friction while maintaining an effective seal, even when the servo piston 32 is tilted. The sealing ring 62, which is preferably constructed of a Teflon™-based material, is available from T-Lon of Hartland, Wis., U.S.A. The O-ring 64 is a standard fluorocarbon/SPM material and is available from a variety of manufacturers under the designation Viton™.

FIGS. 2–5 show that the central portion of the control 22 includes the control bore 51 which houses the stepper motor 50 and the displacement control 52. The stepper motor 50 is connected to one of the control elements, preferably the spool 54. Of course, the feedback member 58 is located on the remote and protruding end of the sleeve 56. The sleeve 56 and the spool 54 include a number of ports and sealing lands thereon which are conventional in the art. The ports are connected to internal passageways 66, 68 within the control housing 38 so as to provide hydraulic oil for control at the servo bores 34, 36. Porting oil to the servo bore 34 causes the corresponding actuator rod 28 to extend and the other actuator to retract. Porting oil to the other servo bore 36 causes the corresponding actuator rod 28 to extend, and therefore the other actuator rod 28 retracts. The control bore 51, the displacement control 52, and the stepper motor 50 are positioned between the servo bores 34, 36 and their respective actuator rods 28.

The control housing is provided in one piece as a unitary casting. This provides shorter control and servo passages. These shorter passages are not as susceptible to hydraulic losses and fluctuations or other phenomena. Obviously, the housing 38 is more compact than existing housings. No outside hoses or tubes are required to make the necessary connections. The control 52 and therefore the unit strokes quickly due to the short internal passages. Finally, the control 52, including the stepper motor 50, is physically protected because of its position between the servo bores 34, 36. The positional accuracy of the spool 54, sleeve 56 and servo bores 34, 36 are increased by the use of common datums for machining and the elimination of joints.

In the drawings and specification there has been set forth a preferred embodiment of the invention, and although specific terms are employed, these are used in a generic and descriptive sense only and not for purposes of limitation. Changes in the form and the proportion of parts as well as in the substitution of equivalents are contemplated as circumstances may suggest or render expedient without departing from the spirit or scope of the invention.

What is claimed is:

1. A variable displacement bent axis unit comprising:

a housing;

a main shaft rotatably supported in the housing;

a yoke pivotally mounted in the housing, the yoke including a recessed well portion and a pivot arm extending outwardly from the recessed well portion to define a pivot axis for the yoke;

a cylinder block carried in the recessed well portion of the yoke and drivingly connected to the main shaft;

first and second elongated actuator rods each having generally opposite first and second ends, the second end including a servo piston thereon, the first end of the first actuator rod being drivingly connected to the pivot arm of the yoke at a first location offset from the pivot axis and the first end of the second actuator rod being drivingly connected at a second location offset from the pivot axis in an opposite direction than the first location; and a closed loop control mechanism for changing the displacement of the unit, the control mechanism including a unitary one-piece control housing including a pair of spaced apart servo bores therein for receiving the servo pistons of the first and second actuator rods respectively and a control bore for receiving a control valve disposed between the servo bores.

2. The bent axis unit of claim 1 wherein the first end of both of the first and second actuator rods includes a substantially spherical external surface for drivingly connecting to the pivot arm.

3. The bent axis unit of claim 2 further comprising first and second socket members each adapted to swivelingly mate with the spherical external surface of the first end of the first and second actuator rods respectively and be inserted in cylindrical holes in the pivot arm at the first and second locations respectively.

4. The bent axis unit of claim 3, wherein the spherical external surface of the first end comprises a ball and the first and second socket members include a concave spherical surface for swivelingly mating therewith.

5. The bent axis unit of claim 1 wherein the servo bores each have a central longitudinal axis, the axes of the servo bores extending in a common general direction yet being skewed from parallel with each other.

6. The bent axis unit of claim 5 wherein control bore extends in the same general direction as the servo bores.

7. The bent axis unit of claim 1 wherein the yoke has a cam member attached thereto and protruding between the first and second locations on the pivot arm so as to engage the control valve between the servo bores.

8. The bent axis unit of claim 7 wherein the control mechanism includes a feedback member for engaging the cam member so as to provide feedback to the control mechanism regarding the pivotal position of the yoke.

9. The bent axis unit of claim 8 wherein the control valve includes a sleeve and a spool slidably mounted within the sleeve, the sleeve being elongated and having opposing ends, one end of the sleeve being slidably mounted in the control bore and the other end protruding from the control housing to define the feedback member.

10. The bent axis unit of claim 9 wherein the control mechanism includes a stepper motor that drivingly engages the spool so as to make the spool movable with respect to the sleeve and the control housing.

11. The bent axis unit of claim 1 wherein the yoke is formed as a single integral one-piece casting.

12. The bent axis unit of claim 11 wherein the cam member is integrally formed on the yoke casting.

13. A variable displacement bent axis unit comprising:

a housing;

a main shaft rotatably supported in the housing;

a yoke pivotally mounted in the housing, the yoke including a recessed well portion and a pivot arm extending outwardly from the recessed well portion to define a pivot axis for the yoke;

a cylinder block carried in the recessed well portion of the yoke and drivingly connected to the main shaft;

first and second elongated actuator rods each having generally opposite first and second ends, the second end including a servo piston thereon, the first end of the first actuator rod being drivingly connected to the pivot arm of the yoke at a first location offset from the pivot axis and the first end of the second actuator rod being drivingly connected at a second location offset from the pivot axis in an opposite direction than the first location; and a closed loop control mechanism for changing the displacement of the unit, the control mechanism including a control housing including a pair of spaced apart servo bores therein for receiving the servo pistons of the first and second actuator rods respectively and a control bore for receiving a control valve located between the servo bores.

* * * * *